US011014384B2

(12) United States Patent
Toia et al.

(10) Patent No.: US 11,014,384 B2
(45) Date of Patent: May 25, 2021

(54) MEDIA SHEET PICK FROM MEDIA TRAY

(71) Applicant: Hewlett-Packard Development Company, L.P., Houston, TX (US)

(72) Inventors: Alexander Toia, Vancouver, WA (US); Kevin Witkoe, Vancouver, WA (US); Jerrod Houston Tyler, Vancouver, WA (US); Bruce A Axten, Camas, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/780,101

(22) PCT Filed: Mar. 29, 2016

(86) PCT No.: PCT/US2016/024742
§ 371 (c)(1),
(2) Date: May 30, 2018

(87) PCT Pub. No.: WO2017/171729
PCT Pub. Date: Oct. 5, 2017

(65) Prior Publication Data

US 2018/0354280 A1 Dec. 13, 2018

(51) Int. Cl.
*B65H 1/18* (2006.01)
*B41J 13/00* (2006.01)
(Continued)

(52) U.S. Cl.
CPC ..... *B41J 13/0018* (2013.01); *B65H 3/0669* (2013.01); *B65H 5/062* (2013.01);
(Continued)

(58) Field of Classification Search
CPC ..... B65H 7/08; B41J 13/103; B41J 29/393
See application file for complete search history.

(56) References Cited

U.S. PATENT DOCUMENTS 5,213,426 A 5/1993 Ewing
5,393,043 A 2/1995 Nitta
(Continued)

FOREIGN PATENT DOCUMENTS

CN 1577174 A 2/2005
CN 1759423 A 4/2006
(Continued)

OTHER PUBLICATIONS

Zebra Technologies, "G Series GK Models: Calibrating the Printer", Feb. 27, 2012, 4 pages.

*Primary Examiner* — Lam S Nguyen
(74) *Attorney, Agent, or Firm* — Michael A Dryja

(57) ABSTRACT

A pick attempt of a media sheet from a media tray is initiated by rotating a pick roller a number of rotations that is set to greater than one in response to the sheet having been designated as a special media sheet type and that is set to one in response to the sheet not having been so designated. In response to a pick sensor detecting the sheet after the pick attempt has been attempted, a turn roller is rotated to advance the sheet to a print engine, and while the turn roller is rotating, the pick roller is rotated to assist advancement of the media sheet. A controller manages per-sheet and per-tray pick attempt counters while the sheet is individually attempted to be picked and advanced, using the counters to determine whether to initiate another pick attempt of the sheet when a current pick attempt has failed.

19 Claims, 4 Drawing Sheets

(51) Int. Cl.

| | |
|---|---|
| ***B65H 3/06*** | (2006.01) |
| ***B65H 5/06*** | (2006.01) |
| ***B65H 7/04*** | (2006.01) |
| ***G03G 15/00*** | (2006.01) |

(52) U.S. Cl.

CPC ..... *B65H 7/04* (2013.01); *G03G 15/6511* (2013.01); *B65H 2511/414* (2013.01); *B65H 2511/51* (2013.01); *B65H 2511/515* (2013.01); *B65H 2513/53* (2013.01); *B65H 2553/82* (2013.01); *G03G 15/70* (2013.01)

(56) References Cited

U.S. PATENT DOCUMENTS

| | | | | |
|---|---|---|---|---|
| 6,032,944 | A * | 3/2000 | Lee | B41J 29/393 271/110 |
| 7,377,508 | B2 | 5/2008 | Rhoads et al. | |
| 7,380,789 | B2 * | 6/2008 | Murrell | B65H 3/0638 271/256 |
| 7,413,182 | B2 | 8/2008 | Powell et al. | |
| 7,549,626 | B2 | 6/2009 | Cook et al. | |
| 7,699,305 | B2 | 4/2010 | Totsuka et al. | |
| 8,113,504 | B2 * | 2/2012 | Cahill | B65H 7/02 271/152 |
| 8,348,256 | B1 | 1/2013 | Aw et al. | |
| 8,746,673 | B1 | 6/2014 | Nickerson et al. | |
| 2005/0275151 | A1 | 12/2005 | Marra et al. | |
| 2011/0101600 | A1 | 5/2011 | Chihara et al. | |
| 2011/0311291 | A1 | 12/2011 | Samoto et al. | |
| 2014/0210895 | A1 | 7/2014 | Sosnowski et al. | |
| 2015/0103112 | A1 | 4/2015 | Lo et al. | |
| 2015/0266314 | A1 | 9/2015 | Toia et al. | |

FOREIGN PATENT DOCUMENTS

| | | |
|---|---|---|
| CN | 104507693 A | 4/2015 |
| EP | 0798124 | 10/1997 |

* cited by examiner

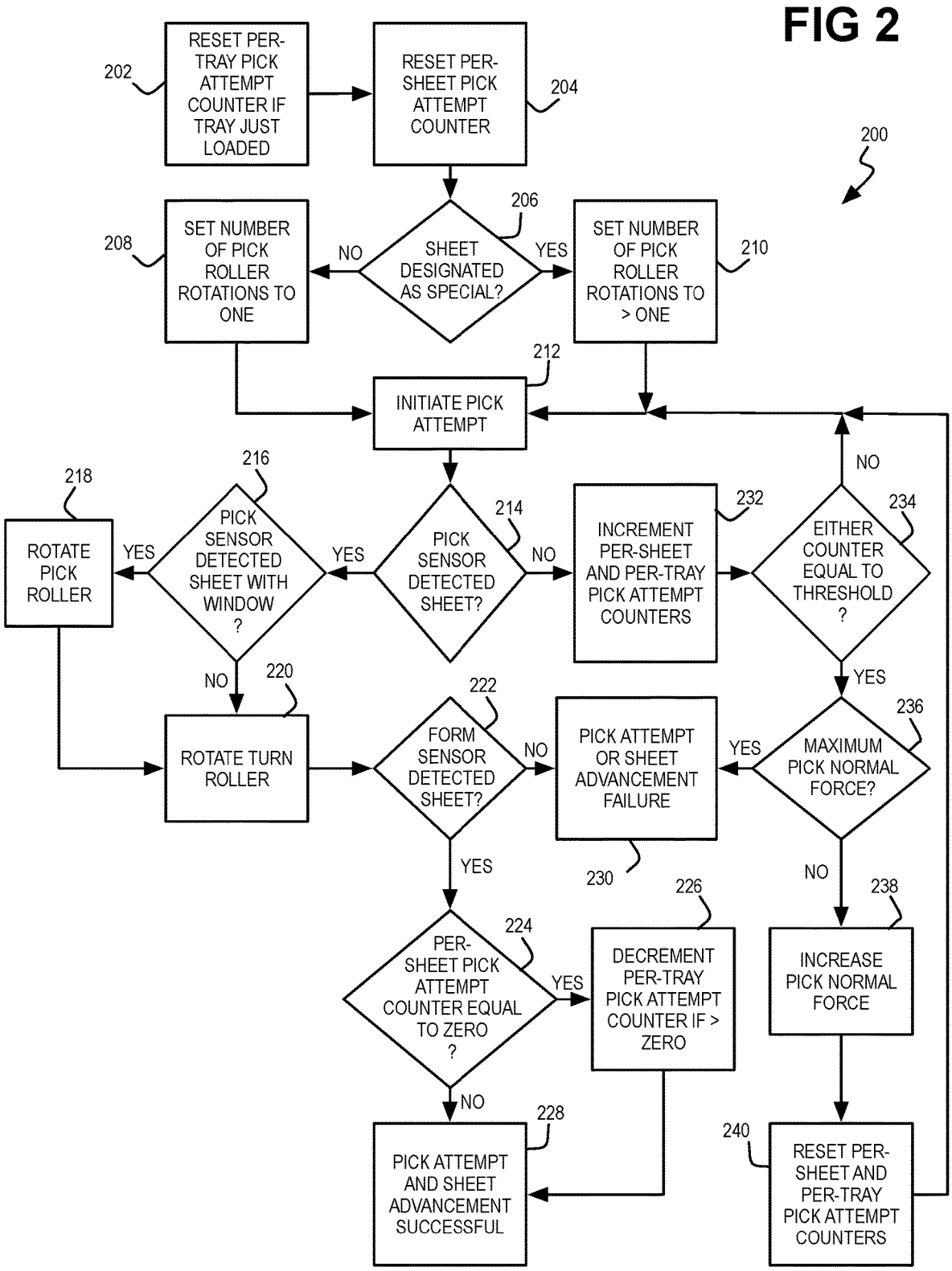
FIG 2
200
202
RESET PER-TRAY PICK ATTEMPT COUNTER IF TRAY JUST LOADED
204
RESET PER-SHEET PICK ATTEMPT COUNTER
206
SHEET DESIGNATED AS SPECIAL?
NO
YES
208
SET NUMBER OF PICK ROLLER ROTATIONS TO ONE
210
SET NUMBER OF PICK ROLLER ROTATIONS TO > ONE
212
INITIATE PICK ATTEMPT
214
PICK SENSOR DETECTED SHEET?
216
PICK SENSOR DETECTED SHEET WITH WINDOW ?
218
ROTATE PICK ROLLER
220
ROTATE TURN ROLLER
222
FORM SENSOR DETECTED SHEET?
224
PER-SHEET PICK ATTEMPT COUNTER EQUAL TO ZERO ?
226
DECREMENT PER-TRAY PICK ATTEMPT COUNTER IF > ZERO
228
PICK ATTEMPT AND SHEET ADVANCEMENT SUCCESSFUL
230
PICK ATTEMPT OR SHEET ADVANCEMENT FAILURE
232
INCREMENT PER-SHEET AND PER-TRAY PICK ATTEMPT COUNTERS
234
EITHER COUNTER EQUAL TO THRESHOLD ?
236
MAXIMUM PICK NORMAL FORCE?
238
INCREASE PICK NORMAL FORCE
240
RESET PER-SHEET AND PER-TRAY PICK ATTEMPT COUNTERS

MEDIA SHEET PICK FROM MEDIA TRAY

BACKGROUND

Printing devices include devices like multi-function devices (MFDs) or all-in-one (AIO) devices that can both form images on media as well as perform other functions such as scanning, as well as devices like printers that can just form images on media. Different technologies that printing devices employ to form images on media like paper include inkjet printing technologies and laser printing technologies. Some types of printing devices utilize media trays, which are loaded with media sheets and then inserted into the devices. A printing device then individually "picks" the media sheets from the tray and advances them to a print engine for forming images thereon.

BRIEF DESCRIPTION OF THE DRAWINGS

FIG. 2 is a flowchart of an example method for improved media sheet picking in which a number of different techniques to provide for such improvement are integrated.

DETAILED DESCRIPTION

As noted in the background section, some types of printing devices use media trays. A printing device can include one or multiple media trays. A user removes a media tray from a printing device, loads media sheets like sheets of paper into the tray, and then inserts the tray back into the device. When the printing device is to form images on one or more media sheets, the device individually picks the media sheets from the tray, and advances them to a print engine, such as a laser or an inkjet print engine, which actually forms an image on each sheet.

Some designs of media trays and some types of media sheets make it more difficult to properly pick a sheet from a tray and advance it to the print engine of a printing device. For example, a media tray design may result in a media sheet having to turn nearly 180 degrees at a relatively tight radius to reach the print engine. As another example, cardstock and other heavy media sheets may be more rigid than standard office paper. In both cases, picking the media sheets from the tray and advancing them to the print engine of the printing device is more difficult, which can result in undesired jamming of the sheets within the device.

Techniques disclosed herein provide for improved media sheet picking from a media tray and advancement to the print engine of a printing device, decreasing the potential for media sheets to jam within the device. In one example technique, a pick roller that is used to pick a media sheet from the media tray continues to rotate to assist a turn roller in advancing the sheet to the print engine. In another example technique, if the media sheet is of a special type, such as cardstock, the pick roller is rotated more than once to pick the sheet from media tray.

In a third example technique, different counters are maintained while each media sheet is individually attempted to be picked from the media tray and advanced to the print engine. The counters include a per-sheet pick attempt counter and a per-tray pick attempt counter. The counters are used to determine whether to initiate another pick attempt of a media sheet when the current pick attempt has failed. The various techniques described herein can be employed individually as well as in conjunction with one another, to decrease the likelihood of undesired media sheet jamming within a printing device.

Figure 1:
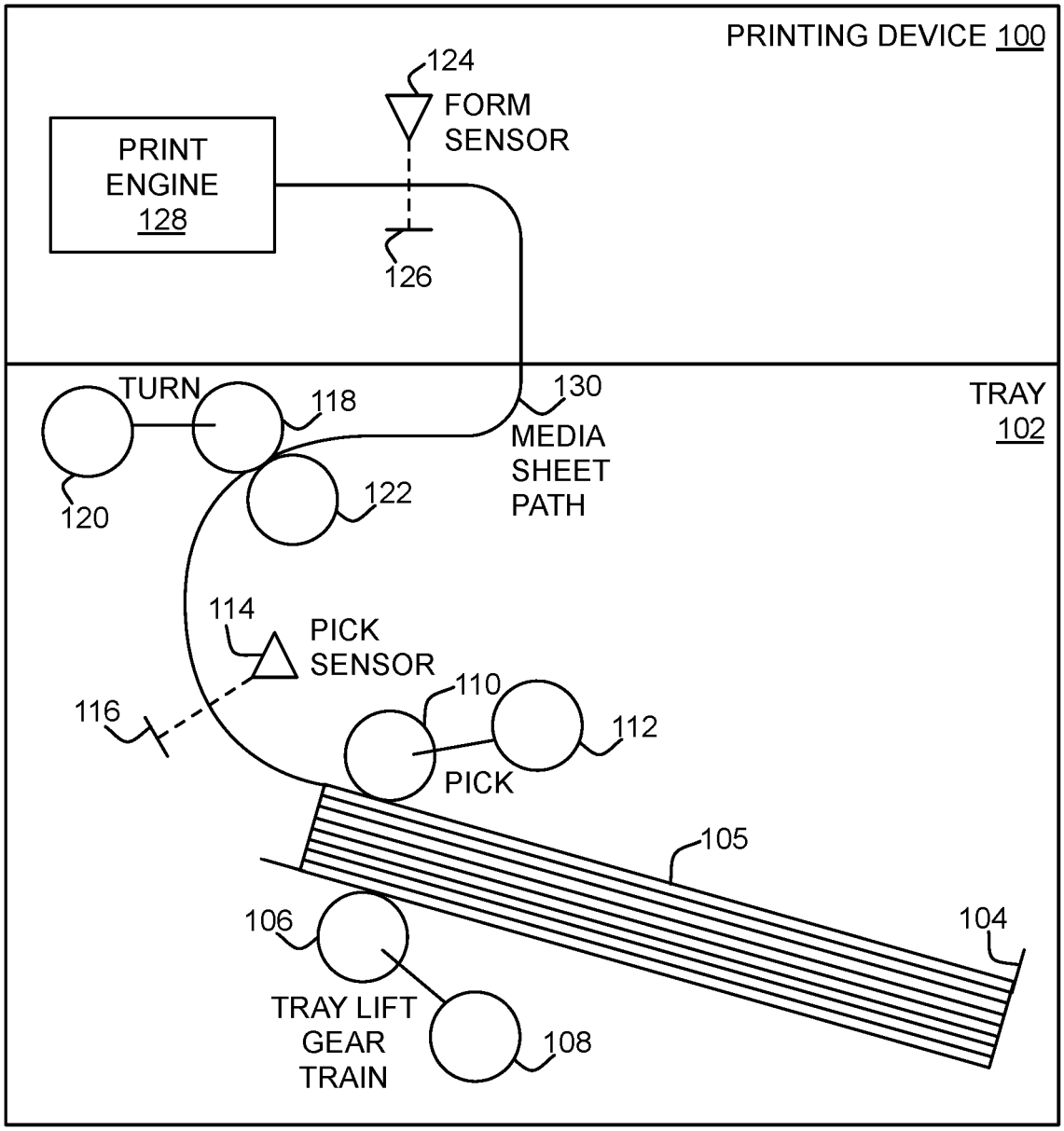
FIG. 1 is a diagram of an example printing device including a media tray from which media sheets are picked and advanced to a print engine of the printing device.

FIG. 1 shows an example printing device 100. The printing device 100 may be a dedicated printer that has just printing functionality, or an all-in-one (AIO) or multi-function (MFP) printing device that has printing functionality as well as other functionality, such as scanning, copying, and/or faxing functionality. The printing device 100 in the example of FIG. 1 includes one media tray 102, but in other implementations, there may be more than one media tray 102.

The media tray 102 is removably insertable into the printing device 100. As such, the media tray 102 is removed from the printing device 100, loaded with a number of media sheets 105, such as sheets of paper or other media, and then inserted back into the device 100. For example, 100 sheets, 250 sheets, or a ream of media sheets (typically 500 sheets) may be loaded into the media tray 102 at one time. The media sheets 105 specifically are placed on a holder tray 104 of the media tray 102.

The printing device 100 includes a tray lift gear train 106 mechanically coupled to a tray lift gear train motor 108. The tray lift gear train 106 exerts a force, which is referred to as a pick normal force, upwards against the holder tray 104. To increase the pick normal force that the tray lift gear train 106 exerts, the tray lift gear train motor 108 rotates the gear train 106, such as in a clockwise direction in the example of FIG. 1, so that it pushes with more force upwards against the holder tray 104.

The printing device 100 includes a pick roller 110 and a pick roller motor 112. The pick roller motor 112 causes the pick roller 110 to rotate, such as in a clockwise direction in the example of FIG. 1. Rotation of the pick roller 110 picks the top-most media sheet 105 from the holder tray 104 to begin to advance the media sheet 105 along a media sheet path 130 to a print engine 128 of the printing device 100. The pick normal force exerted by the tray lift gear train 106 against the holder tray 104 causes the media sheets 105 loaded on the tray 104 to exert the same (or nearly the same) force against the pick roller 110. This force increases friction of the top-most media sheet 105 against the pick roller 110, which assists the pick roller 110 in picking this sheet 105 from the holder tray 104.

The printing device 100 includes a pick sensor 114. The pick sensor 114 may be an optical sensor that emits a beam of light, such as infrared light, via a photodiode, for instance, towards a mirror 116 or other reflective surface. The mirror 116 reflects the light back to the pick sensor 114, which can include a photo sensor to detect the reflected light. The pick sensor 114 thus detects whether the pick roller 110 has successfully picked the top-most media sheet 105 from the holder tray 104. If the pick sensor 114 detects light, this means that there is no media sheet 105 between the sensor 114 and the mirror 116, which occurs when there has been an unsuccessful pick. If the pick sensor 114 does not detect light, this means that there is a media sheet 105 between the sensor 114 and the mirror 116 blocking the light, which occurs when there has been a successful pick.

The printing device 100 includes an active turn roller 118 and a turn roller motor 120, and can include a passive turn roller 122 as well. The turn roller motor 120 causes the active turn roller 118 to rotate, such as in a counter-clockwise direction in the example of FIG. 1. The passive turn roller 122 is not actively driven by a motor, such as the turn roller motor 120. Rather, when a media sheet 105 is advancing along the media sheet path 130 between the active turn roller 118 and the passive turn roller 122, the passive turn roller 122 is caused to rotate, such as in a clockwise direction in the example of FIG. 1, resulting from its contact with the media sheet 105 and the rotation of the active turn roller 118. The active turn roller 118 may be referred to as just a turn roller. The turn rollers 118 and 122 advance the media sheet 105 along the media sheet path 130 towards the print engine 128.

The printing device includes a form sensor 124, which may also be referred to as a top-of-form sensor. The form sensor 124 may be an optical sensor that emits a beam of light, such as infrared light, via a photodiode, for instance, towards a mirror 126 or other reflective surface. The mirror 126 reflects the light back to the form sensor 124, which can include a photo sensor to detect the reflected light. The form sensor 124 detects whether the turn rollers 118 and 122 have successively advanced the media sheet 105 to the print engine 128. If the form sensor 124 detects light, this means that there is no media sheet 105 between the sensor 124 and the mirror 126, which occurs when there has been unsuccessful media advancement to the print engine 128. If the form sensor 124 does not detect light, this means that there is a media sheet 105 between the sensor 124 and the mirror 126 blocking the light, which occurs when the media sheet 105 has been successfully advanced to the print engine 128.

The print engine 128 is the component of the printing device 100 that actually forms images, including graphics and text, on the media sheets 105. The print engine 128 can be a laser-printing print engine that employs laser-printing technology to form images on the media sheets 105. The print engine 128 can be an inkjet-printing print engine that employs inkjet-printing technology to form images on the media sheets 105. The print engine 128 can employ a different type of printing technology as well.

Within the printing device 100, there can be two aspects that can make it more difficult to properly pick a media sheet 105 from the holder tray 104 of the media tray 102 and advance the sheet 105 to the print engine 128. First, the media sheet 105 may have to turn nearly 180 degrees at a relatively tight radius, one or more times, after being picked by the pick sensor and advanced by the turn roller 118, in being advanced to the print engine 128. When such turning or bending of the media sheet 105 is severe, the potential for the sheet 105 to jam within the printing device 100 increases. Second, the media sheet 105 may be heavy, rigid, and/or relatively inflexible, like cardstock is. This can increase the potential for the media sheet 105 to jam within the printing device 100, because the picking and/or advancing of such a sheet 105 becomes more difficult.

FIG. 2 shows an example method 200 for improved picking of a media sheet 105 from the media tray 102 (and more specifically from the holder tray 104 thereof) and advancing of the sheet 105 to the print engine 128 of the printing device 100. The method 200 incorporates the three examples techniques outlined above for such improved media sheet picking and advancement. Later in the detailed description, by comparison, each technique is described individually. The method 200 may be performed by a controller of the printing device 100 that executes computer-executable code stored on a non-transitory computer-readable data storage medium. In this respect, the controller causes the parts of the method 200 to be performed. The method 200 is performed on a media sheet-by-media sheet basis. That is, the method 200 is performed each time a media sheet 105 is to be advanced to the print engine 128 for forming an image thereon.

A per-tray pick attempt counter is reset to zero when the media tray 102 is (re)inserted into the printing device 100 (202). Presumably, the media tray 102 is removed from the printing device 100 when there are no more media sheets 105 within the tray 102. A user adds media sheets 105 to the media tray 102, and reinserts the tray 102 into the printing device 100. At this time, then, the per-tray pick attempt counter is reset to zero.

The per-tray pick attempt counter tracks the number of unsuccessful pick attempts that the pick roller 110 makes for the media tray 102 as a whole. That is, the per-tray pick attempt counter is not reset each time a new media sheet 105 is to be advanced to the print engine 128. Stated another way, the per-tray pick attempt counter is not necessarily reset every time the method 200 is performed for a new media sheet 105, but rather is reset just when the media tray 102 is (re)inserted into the printing device 100. However, the per-track pick attempt counter is novelly decremented in certain situations, as described below.

A per-sheet pick attempt counter is also reset to zero (204). The per-sheet pick attempt counter tracks the number of unsuccessful pick attempts that the pick roller 110 makes for the current media sheet 105 in relation to which the method 200 is currently being performed. As such, in contradistinction to the per-tray pick attempt counter, the per-sheet pick attempt counter is reset each time a new media sheet 105 is to be advanced to the print engine 128. Stated another way, the per-sheet pick attempt counter is reset every time the method 200 is performed for a new media sheet 105.

A media sheet 105 can be designated as being a special media sheet type or not. A special media sheet type can be one that is heavier, more rigid, and/or less flexible, for instance, than a regular sheet of office paper, and as msch has a greater potential to jam within the printing device 100 when being picked and then advanced along the media sheet path 130. A user may designate that the type of media loaded within the media tray 102 is of the special media sheet, or a sensor of the printing device 100 may make this determination.

In response to the media sheet 105 not having been designated as the special media sheet type (206), the number of pick roller rotations is set to one (208), whereas in response to the sheet 105 having been designated as the special media sheet type (206), the number of pick roller rotations is set to a number greater than one (210), in one implementation. The number of pick roller rotations that is set is the number of rotations that the pick roller motor 112 rotates the pick roller 110, at least to pick the media sheet 105 from the holder tray 104. By increasing the number of pick roller rotations greater than one for a media sheet 105 of the special media type, this technique novelly increases the likelihood that a successful pick of the sheet 105 by the pick roller 110 from the holder tray 104 will occur.

A first pick attempt of the media sheet 105 is initiated (212). Specifically, the pick roller motor 112 rotates the pick roller 110 a number of times equal to the set number of pick roller rotations. A specified time window is measured, or begins, a specified length of time after the rotation of the pick roller 110 has started. With respect to this time window, there are three possible outcomes of the pick attempt initiated in part 212. First, the pick attempt may be successful, but occur prior to the specified time window. Second, the pick attempt may be successful, but occur within the specified time window. Third, the pick attempt may be unsuccessful. The latter outcome occurs when the specified time window has expired, and the media sheet 105 has not yet been picked (as detected by the pick sensor 114).

Therefore, in response to the pick sensor 114 detecting the media sheet 105 (214), it is known that there has been a successful pick attempt of the sheet 105. If the pick sensor 114 detected the sheet 105 within the specified window of time, then the pick roller motor 112 again rotates the pick roller 110 (218), and the turn roller motor 120 also rotates the turn roller 118 (220). By comparison, if the pick sensor 114 has not detected the sheet 105 within the specified window of time (i.e., the sensor 114 has detected the sheet 105 prior to the specified window of time) (216), then the turn roller motor 120 rotates the turn roller 118 (220), and the pick roller motor 112 does not again rotate the pick roller 110.

The turn roller 118 may be rotated continuously in part 220 until the form sensor 124 has detected the media sheet 105 or not, as will be described. By comparison, in one implementation, the pick roller 110 may be rotated a number of times in part 218 equal to the number of pick roller rotations set in part 208 or part 210. In another implementation, the pick roller 110 may be rotated a number of times in part 218 equal to the number of pick roller rotations that would be set in part 210, regardless of whether part 208 or part 210 is performed. In a third implementation, the pick roller 110 may be rotated until the pick sensor 114 no longer detects the media sheet 105.

The purpose of rotating the pick roller 110 in part 218 upon the pick sensor 114 detecting the media sheet 105 within the specified window of time, but not rotating the pick roller 110 upon the pick sensor 114 detecting the media sheet 105 prior to commencement of the specified window of time, is as follows. If the pick roller 110 is not able to easily (and thus quickly) pick the media sheet 105 from the holder tray 104 upon the initiation of the pick attempt in part 212, then the pick sensor 114 will detect the sheet 105 within the specified window of time, as opposed to prior to the specified window of time. Therefore, it is novelly concluded that since the pick roller 110 had difficulty picking the media sheet 105, the turn roller 118 may also have difficulty advancing the sheet 105 to the print engine 128. As such, the pick roller 110 is novelly and again rotated in part 218, to assist the turn roller 118 in advancing the media sheet 105 to the print engine 128. This technique is novel at least because the pick roller 110 is being employed for a purpose other than that for which it is intended—that is, instead of using the pick roller 110 just to pick the media sheet 105 from the holder tray 104, the pick roller 110 is also used to assist the turn roller 118 in advancing the sheet 105 to the print engine 128.

By comparison, if the pick roller 110 is able to easily (and thus quickly) pick the media sheet 105 from the holder tray 104 upon the initiation of the pick attempt in part 212, then the pick sensor 114 will detect the sheet 105 prior to commencement of the specified window of time, as opposed to within the specified window of time. Therefore, it is novelly concluded that since the pick roller did not have difficulty picking the media sheet 105, the turn roller 118 is also likely to not encounter difficulty advancing the sheet 105 to the print engine 128. As such, the pick roller 110 does not have to be rotated again, since the turn roller 118 is likely not to need assistance in advancing the media sheet 105 to the print engine 128.

For a particular design of a media tray 102, it can be determined and thus it is known how long it should take for the turn roller 118, with or without the assistance of the pick roller 110, to advance the media sheet 105 along the media sheet path 130 just prior to the print engine 128, where the form sensor 124 is able to detect the sheet 105 or not. Therefore, if the form sensor 124 has detected the media sheet 105 by the expiration of such a specified length of time (222), then it is known that both the pick attempt of part 212 and the media sheet advancement of parts 218 and/or 220 have been successful. However, prior to the method 200 ending, if the per-sheet pick attempt counter is still equal to zero (224), then the per-tray pick attempt counter is decremented by one if it is greater than zero (226), before ending the method 200 with a successful pick attempt and media sheet advancement (228). That is, it is determined that the pick attempt and media sheet advancement are successful. By comparison, if the per-sheet pick attempt counter has been incremented and thus is greater than zero (224), then the method 200 ends with a successful pick attempt and media sheet advancement (228) without decrementing the per-tray pick attempt counter.

As will be described, the per-sheet pick attempt counter and the per-tray pick attempt counter are each incremented when a pick attempt is initiated in part 212 but has failed. If there is no pick attempt failure for the current media sheet 105, then the per-sheet pick attempt counter will have not been incremented and will remain at zero. However, the per-tray pick attempt counter, while also not having been incremented with respect to the current media sheet 105, may still have a value greater than zero, due to a pick attempt failure with a prior media sheet 105. As noted above, in other words, when the method 200 is performed for a new media sheet 105, the per-sheet pick attempt counter is reset to zero in part 204, but the per-tray pick attempt counter is not reset to zero, unless the media tray 102 has just been (re)inserted into the printing device 100.

As will also be described, if either or both of the per-sheet pick attempt counter and the per-tray pick attempt have reached a threshold, which may be the same or different for each counter, then the method 200 ends with an unsuccessful pick attempt. Having both a per-sheet pick attempt counter and a per-tray pick attempt counter, while decrementing the per-tray pick attempt counter if the first pick attempt of a given media sheet 105 is successful, is a novel technique to balance the desire to keep printing on the one hand even if periodically some media sheets 105 require more than one pick attempt, and to stop printing on the other hand if many media sheets 105 in a row require more than one pick attempt. An example is illustrative in this respect.

Assume, for instance, that the threshold for each of the two counters is fifteen. If a first media sheet 105 requires two pick attempts, then the per-tray pick attempt counter is one (i.e., equal to one unsuccessful pick attempt), and the per-sheet pick attempt counter is also one (i.e., again equal to one unsuccessful pick attempt). If the very next media sheet 105 also requires two pick attempts, then the per-tray pick attempt counter becomes two, since this counter is not necessarily reset each time the method 200 is performed, whereas the per-sheet pick attempt is one, since it is reset each time the method 200 is performed.

Assume that this situation occurs for every media sheet 105, that it takes two pick attempts to pick each sheet 105 from the media tray 102. If there were no per-tray pick attempt counter, then printing would continue without, for instance, notifying the user, because for any given media sheet 105, the threshold of unsuccessful pick attempts is never reached. However, this situation can be undesirable, because printing would slow due to two pick attempts being needed to pick each media sheet 105. Therefore, using a per-tray pick attempt counter novelly ensures that if the pick roller 110 is having difficulty picking up media sheets 105, at some point the per-tray pick attempt counter will reach the threshold, and printing will cease.

However, say that for a given ream of media sheets 105 loaded within media tray 102, there are a few groups of contiguous media sheets 105 that each need more than one pick attempt. This scenario may be more tenable, and stopping printing may be undesirable. If the per-tray pick attempt counter is incremented each time any media sheet 105 encounters an unsuccessful pick attempt, without any decrementation, then this counter will likely by the second or third group of contiguous sheets 105 reach the threshold, such that printing undesirably stops. Therefore, by novelly decrementing the per-tray pick attempt counter in part 226 if the current media sheet 105 has been successfully picked on its first pick attempt (i.e., the per-sheet pick attempt counter is zero when part 224 is reached), this situation is at least less likely to occur. As noted above, having both per-sheet and per-tray pick attempt counters, while decrementing the per-tray pick attempt counter if the first pick attempt of a given media sheet 105 is successful, thus novelly balances the desire to keep printing even if periodically some sheets 105 need more than one pick attempt, and to stop printing if many sheets 105 in a row require more than one pick attempt.

Referring still to FIG. 2, if by the end of the expected time the form sensor 124 has not detected the media sheet 105 after at least the turn roller 118 has rotated to advance the sheet 105 along the media sheet path 130 to the print engine 128 (222), then the method 200 ends with a successful pick attempt but with unsuccessful media advancement to the print engine 128 (230). That is, it is determined that the pick attempt is successful but that the media advancement has failed. The pick attempt is successful because the pick sensor 114 has detected the sheet 105 prior to or within the specified time window in part 214. The media advancement to the print engine 128, though, is unsuccessful because the form sensor 124 has not detected the media sheet 105.

Further, if after the pick attempt has been initiated in part 212 the pick sensor has not detected the media sheet 105 by the end of the specified time window (214), then the pick attempt of the sheet 105 is deemed unsuccessful. Both the per-sheet and the per-tray pick attempt counters are each incremented (232) to denote that an unsuccessful pick attempt has occurred. If neither the per-sheet counter nor the per-tray pick attempt counter has reached its corresponding threshold (234), then another pick attempt of the media sheet 105 is initiated (212). As noted above, the per-sheet and per-tray pick attempt counters may have the same threshold, or they may have different thresholds. The per-sheet pick attempt counter may have a per-sheet pick attempt counter threshold, for instance, while the per-tray pick attempt counter may have a per-tray pick attempt counter threshold.

However, if either the per-sheet counter or the per-tray pick attempt counter (or both counters) has reached its corresponding threshold (234), then the pick normal force exerted by the tray lift gear train 106 against the holder tray 104 and by extension to the media sheets 105 against the pick roller 110 is examined. Specifically, if the maximum pick normal force has not yet been exerted (236), then the pick normal force is increased (238). This is achieved by the tray lift gear train motor 108 further causing the tray lift gear train 106 to exert more force against the holder tray 104. For example, the tray lift gear train 106 may have a number of discrete force levels, from a minimum pick normal force to a maximum pick normal force. When the media tray 102 is (re)inserted into the printing device 100, the act of insertion may cause the tray lift gear train 106 to reset to the minimum pick normal force.

Once the pick normal force has been increased to the next discrete level, for instance, then both the per-sheet and per-tray pick attempt counters are reset to zero (240), and another pick attempt of the current media sheet 105 is attempted (212). In this respect, the per-tray pick attempt counter may even more accurately be referred to as a per-tray pick normal force level pick attempt counter, since it is reset at each pick normal force level, including at the minimum pick normal force when the media tray 102 is (re)inserted into the printing device 100. However, ultimately if either or both pick-attempt counters have reached their corresponding thresholds (234), and the maximum pick normal force has already been reached (236), then the method 200 ends with an unsuccessful pick attempt (230). That is, it is determined that the pick attempt has failed. Unsuccessful media advancement in this case likewise occurs, since a successful pick attempt is needed for successful media advance to the print engine 128 to occur.

The method 200 that has been described thus provides for improved media sheet picking from the media tray 102. Three particular techniques for such improved media sheet picking are intertwined within the method 200. Each of these three techniques is now described separately. It is noted that the techniques can be used individually, together, as is the case with the method 200, or in any combination thereof.

Figure 3:
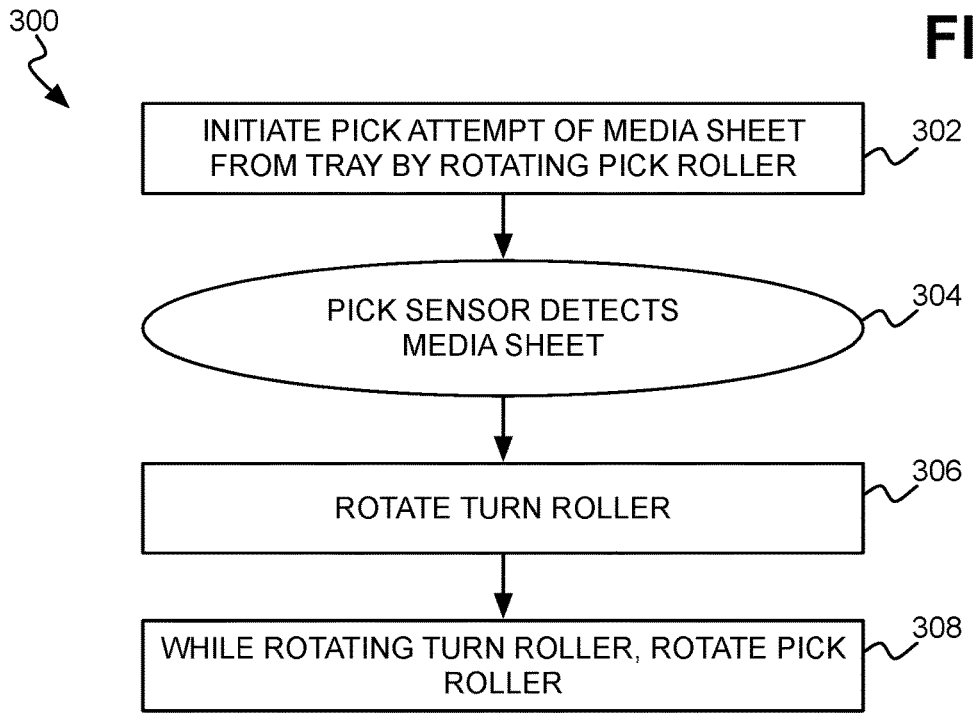
FIG. 3 is a flowchart of an example method for improved media sheet picking using one of the three techniques of the method of FIG. 2.

FIG. 3 shows an example method 300 for improved media sheet picking from the media tray 102 and media advancement to the print engine 128 using a first particular technique. A pick attempt of a media sheet 105 is attempted from the holder tray 104 of the media tray 102 by the pick roller motor 112 rotating the pick roller 110 (302). In response to the pick sensor 114 detecting the media sheet 105 (304), the turn roller motor 120 rotates the turn roller 118 (306). While the turn roller 118 is rotating, the pick roller motor 112 rotates the pick roller 110 (308). As such, the pick roller 110 assists the turn roller 118 in advancing the media sheet 105 along the media sheet path 130 towards the print engine 128.

The example method 300 can differ from the way in which the technique is integrated in the example method 200 in that in the method 300, the pick roller 110 may be rotated in part 308 regardless of whether the pick sensor 114 detects the media sheet 105 within the specified time window or prior to this window beginning. By comparison, in the method 200, the pick roller 110 is rotated while the turn roller 118 rotates just if the pick sensor 114 detects the media sheet 105 within the specified time window. However, in another implementation, the method 300 may likewise rotate the pick roller 110 while the turn roller 118 rotates just if the pick sensor 114 detects the media sheet 105 within the specified time window, and not prior to the window.

Figure 4:
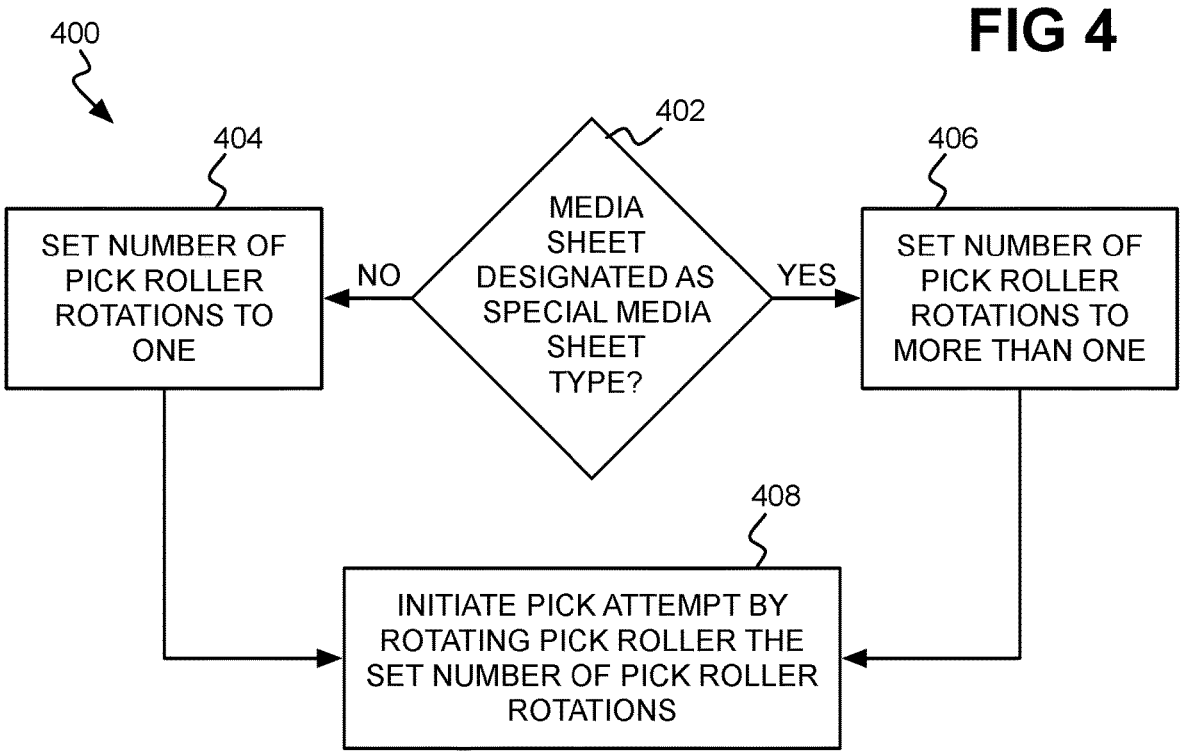
FIG. 4 is a flowchart of an example method for improved media sheet picking using another of the three techniques of the method of FIG. 2.

FIG. 4 shows an example method 400 for improved media sheet picking from the media tray 102 using a second particular technique. In response to a media sheet 105 having not been designated as of a special media sheet type (402), a number of pick roller rotations is set to one (404). By comparison, in response to the media sheet 105 having been designated as of the special media sheet type (402), the number of pick roller rotations is set to more than one (406), such as to two. A pick attempt is then initiated by the pick roller motor 112 rotating the pick roller 110 the set number of pick roller rotations (408).

As such, the example method 400 implements one of the techniques that are integrated within the example method 200. By rotating the pick roller 110 more than once when the media sheet 105 is of the special media sheet type, the likelihood that the sheet 105 will be successfully picked from the holder tray 104 of the media tray 102 is increased, as compared to if the roller 110 were rotated just once. It is noted that both the example methods 300 and 400 can have their constituent parts performed by a controller of the printing device 100, as described above in relation to the method 200. The methods 300 and 400 further in this respect can be implemented as computer-executable code stored on a non-transitory computer-readable data storage medium.

Figure 5:
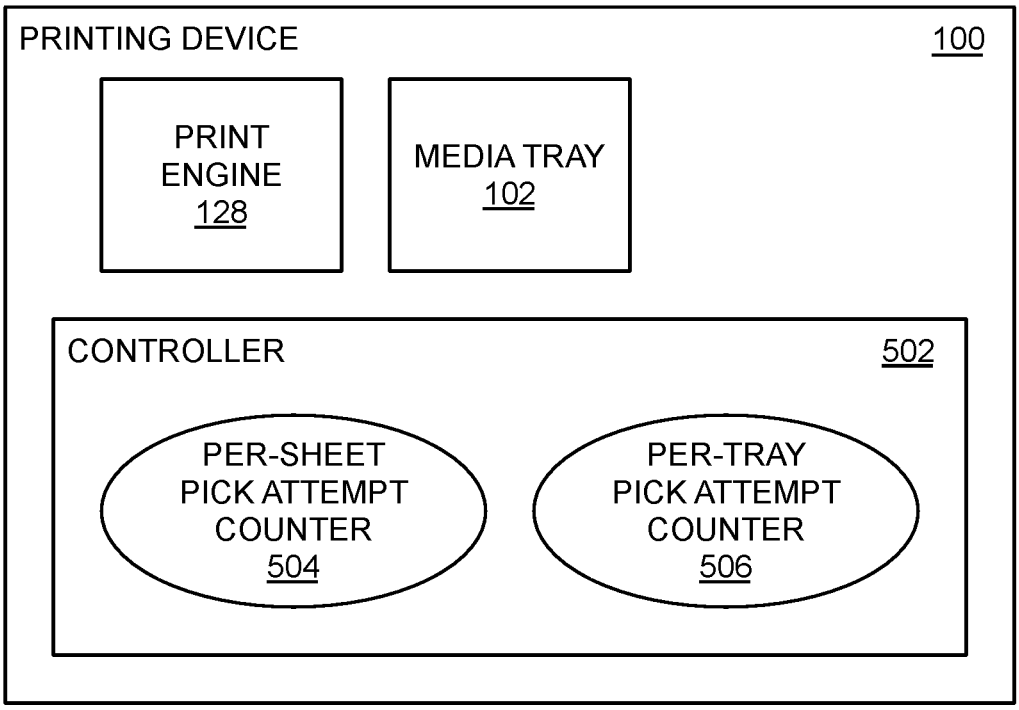
FIG. 5 is a diagram of an example printing device using a third of the three techniques of the method of FIG. 2.

FIG. 5 shows the example printing device 100 for improved media sheet picking and media advancement using a third particular technique. The printing device 100 is depicted in FIG. 5 as including at least the media tray 102, the print engine 128, and a controller 502. The controller 502 may be a general purpose processor that executes computer-executable code stored on a non-transitory computer-readable data storage medium. In another implementation, the controller 502 may be implemented as a field-programmable gate array (FPGA) or an application-specific integrated circuit (ASIC) that is suitably programmed.

The controller 502 manages a per-sheet pick attempt counter 504 and a per-tray pick attempt counter 506 while media sheets are individually attempted to be picked from the media tray 102 and advanced to the print engine 128. The controller 502 uses the counters 504 and 506 to determine whether to initiate another pick attempt of any given media sheet when the current pick attempt of that sheet has failed. In this respect, the controller 502 can perform the method 200 that has been described, including at least the parts thereof pertaining to the counters 504 and 506.

Techniques have thus been disclosed herein that improve at least media sheet picking from media trays of printing devices. Implementing one or more of these techniques reduces the likelihood that media sheets will not be successfully picked and/or will not be successfully advanced to a print engine of a printing device. This results in a better user experience of such a printing device, and further provides an objective improvement in the technology of printing devices, by decreasing media sheet jamming within such devices.

We claim:

1. A method comprising:

initiating a pick attempt of a media sheet from a media tray of a printing device by rotating a pick roller of the printing device via a pick motor of the printing device;

in response to a pick sensor of the printing device, which is a closest media sheet detection sensor to the pick roller along a media sheet path, detecting the media sheet after the pick attempt has been initiated:

rotating a turn roller of the printing device, which is a closest media sheet advancement roller to the pick roller along the media sheet path, via a turn motor of the printing device to advance the media sheet to a print engine of the printing device;

while rotating the turn roller, rotating the pick roller via the pick motor to assist the turn roller in advancing the media sheet to the print engine, while the turn roller is advancing the media sheet to the print engine;

incrementing a per-sheet pick attempt counter;

incrementing a per-tray pick attempt counter; and using the per-sheet pick attempt counter and the per-tray pick attempt counter to determine whether to initiate another pick attempt of any sheet when a current pick attempt has failed.

2. The method of claim 1, wherein the pick roller is rotated via the pick motor to assist advancement of the media sheet to the print engine in response to the pick sensor detecting the media sheet within a specified time window, the method further comprising, in response to the pick sensor detecting the media sheet prior to the specified time window:

rotating the turn roller via the turn motor to advance the media sheet to the print engine, without rotating the pick roller to assist advancement of the media sheet to the print engine.

3. The method of claim 2, further comprising, in response to a form sensor of the printing device detecting the media sheet near the print engine:

determining that the pick attempt of the media sheet has succeeded and that advancement of the media sheet to the print engine has succeeded.

4. The method of claim 3, further comprising, in response to the form sensor detecting the media sheet near the print engine:

in response to determining that a per-sheet pick attempt counter is equal to zero, decrementing a per-tray pick attempt counter if the per-tray pick attempt counter is greater than zero, wherein the per-sheet pick attempt counter and the per-tray pick attempt counter are each incremented responsive to the pick sensor failing to detect the media, wherein the per-sheet pick attempt counter is reset to zero when initiating a first pick attempt of any media sheet, and wherein the per-tray pick attempt counter is reset to zero when loading the tray into the printing device and is not reset to zero when initiating the first pick attempt of any media sheet.

5. The method of claim 3, further comprising, in response to the form sensor failing to detect the media sheet near the print engine:

determining that the advancement of the media sheet to the print engine has failed.

6. The method of claim 1, wherein using the per-sheet pick attempt counter and the per-tray pick attempt counter to determine whether to initiate another pick attempt of any sheet when a current pick attempt has failed comprises:

in response to the per-sheet pick attempt counter being less than a per-sheet pick attempt threshold and the per-tray pick attempt counter being less than a per-tray pick attempt threshold, initiating another pick attempt of the media sheet from the tray by rotating the pick roller via the pick motor, wherein the per-sheet pick attempt counter is reset to zero when initiating a first pick attempt of any media sheet, and wherein the per-tray pick attempt counter is reset to zero when loading the tray into the printing device and is not reset to zero when initiating the first pick attempt of the any media sheet.

7. The method of claim 6, further comprising, in response to the per-sheet pick attempt counter being equal to the per-sheet pick attempt threshold or the per-tray pick attempt counter being equal to the per-tray pick attempt threshold:

in response to determining that the tray lift gear train is not exerting a maximum pick normal force:

resetting the per-sheet pick attempt counter to zero;

rotating the tray lift gear train via a tray lift gear train motor of the printing device to increase a pick normal force exerted by the tray lift gear train;

resetting the per-tray pick attempt counter to zero;

initiating another pick attempt of the media sheet from the tray by rotating the pick roller via the pick motor.

8. The method of claim 7, further comprising, in response to the per-sheet pick attempt counter being equal to the per-sheet pick attempt threshold or the per-tray pick attempt counter being equal to the per-tray pick attempt threshold:

in response to determining that a tray lift gear train of the printing device is exerting the maximum pick normal force, determining that the pick attempt of the media sheet has failed.

9. The method of claim 1, further comprising:

in response to the media sheet having been designated as a special media sheet type, setting a number of pick roller rotations to a predetermined number greater than one;

in response to the media sheet not having been designated as the special media sheet type, setting the number of pick roller rotations to one, wherein initiating the pick attempt of the media sheet from the tray by rotating the pick roller via the pick motor comprises:

rotating the pick roller the number of pick roller rotations that has been set.

10. The method of claim 1, further comprising:

detecting, by a form sensor of the printing device located downstream from the pick sensor and upstream from the print engine, the media sheet to the print engine after the pick sensor has detected the media sheet.

11. The method of claim 1, wherein the pick sensor detects whether the pick attempt that has been initiated by rotating the pick roller is successful in picking the media sheet from the media tray.

12. The method of claim 1, wherein within a printing path between the pick roller and the turn roller, the pick sensor is closer than any other media detection sensor to the pick roller.

13. The method of claim 1, wherein within a printing path between the pick roller and the turn roller, the pick sensor is an only media detection sensor.

14. The method of claim 1, wherein within a printing path between the pick roller and the turn roller, the turn roller is closer than any other motorized roller to the pick roller.

15. The method of claim 1, wherein within a printing path between the pick roller and the turn roller, the turn roller is an only motorized roller other than the pick roller.

16. A printing device comprising:

a print engine;

a media tray to hold a plurality of media sheets, and from which each sheet is individually picked and advanced to the engine; and a controller to:

manage a per-sheet pick attempt counter and a per-tray pick attempt counter while each sheet is individually attempted to be picked and advanced to the engine, and use the per-sheet pick attempt counter and the per-tray pick attempt counter to determine whether to initiate another pick attempt of any sheet when a current pick attempt has failed.

17. The printing device of claim 16, further comprising:

a pick sensor of the printing device to detect whether each sheet has been successfully picked from the tray; and a form sensor to detect whether each sheet has been successfully advanced to the print engine, wherein the controller is to increment the per-sheet pick attempt counter and the per-tray pick attempt counter responsive to the pick sensor failing to detect that any sheet has been successfully picked from the tray after a pick attempt, where the controller is to decrement the per-tray pick attempt counter responsive to the form sensor detecting that any sheet has been successfully advanced to the print engine after a first pick attempt.

18. The printing device of claim 17, further comprising:

a tray lift gear train of the printing device to exert a pick normal force against the media sheets within the tray, wherein the controller is to reset the per-sheet pick attempt counter prior to the first pick attempt, and after the pick normal force of the tray has been increased, wherein the controller is to reset the per-tray pick attempt counter when the tray has been reloaded into the printing device, wherein if the per-sheet pick attempt counter or the per-tray pick attempt counter after being incremented is equal to a corresponding threshold, the controller is to increase the pick normal force if the pick normal force is less than a maximum pick normal force, and wherein if the per-sheet pick attempt counter and the per-tray pick attempt counter after being incremented are each less than the corresponding threshold, the controller is to initiate another pick attempt.

19. The printing device of claim 16, wherein the controller is to decrement the per-tray pick attempt counter responsive to any sheet having been successfully advanced to the print engine after the first attempt.

* * * * *